US010180241B1

(12) United States Patent
Van Winkle

(10) Patent No.: US 10,180,241 B1
(45) Date of Patent: Jan. 15, 2019

(54) CONVERSION DEVICE FOR LINKING CORD

(71) Applicant: ETi Solid State Lighting Inc., Vernon Hills, IL (US)

(72) Inventor: Gary Van Winkle, Chagrin Falls, OH (US)

(73) Assignee: ETi Solid State Lighting Inc., Vernon Hills, IL (US)

( * ) Notice: Subject to any disclaimer, the term of this patent is extended or adjusted under 35 U.S.C. 154(b) by 0 days.

(21) Appl. No.: 15/702,918

(22) Filed: Sep. 13, 2017

(51) Int. Cl.

| | |
|---|---|
| ***F21V 3/02*** | (2006.01) |
| ***F21S 8/06*** | (2006.01) |
| ***F21V 21/005*** | (2006.01) |
| ***F21V 23/06*** | (2006.01) |
| ***F21V 15/015*** | (2006.01) |
| ***F21V 23/00*** | (2015.01) |
| ***F21V 29/70*** | (2015.01) |
| ***F21V 17/16*** | (2006.01) |
| ***F21V 23/04*** | (2006.01) |
| *F21Y 103/10* | (2016.01) |
| *F21Y 115/10* | (2016.01) |

(52) U.S. Cl.
CPC ..... *F21V 21/005* (2013.01); *F21S 8/061* (2013.01); *F21V 3/02* (2013.01); *F21V 15/015* (2013.01); *F21V 17/16* (2013.01); *F21V 23/009* (2013.01); *F21V 23/04* (2013.01); *F21V 23/06* (2013.01); *F21V 29/70* (2015.01); *F21Y 2103/10* (2016.08); *F21Y 2115/10* (2016.08)

(58) Field of Classification Search
CPC ..... F21V 21/005; F21V 23/04; F21V 23/06
See application file for complete search history.

(56) References Cited

U.S. PATENT DOCUMENTS

| | | | | |
|---|---|---|---|---|
| 7,513,640 | B2 * | 4/2009 | Hendrikus | H01R 33/08 362/219 |
| 2005/0041418 | A1 * | 2/2005 | Fan | F21V 23/008 362/217.05 |
| 2006/0009070 | A1 * | 1/2006 | Liu | H01R 31/065 439/502 |
| 2007/0141869 | A1 * | 6/2007 | McNeely | A61B 5/0006 439/76.1 |
| 2012/0188756 | A1 * | 7/2012 | Kokoski | F21L 14/023 362/217.05 |

* cited by examiner

*Primary Examiner* — Evan P Dzierzynski
(74) *Attorney, Agent, or Firm* — Walter | Haverfield LLP; D. Peter Hochberg; Sean F. Mellino

(57) ABSTRACT

A conversion device for converting a linking cord for electrically linking two linkable LED lighting fixtures together to a power cord, the conversion device having a body portion with a portion for receiving a plug of a linking cord, and a portion with prongs for insertion into an electrical outlet for transmitting electricity to a linkable LED lighting fixture to which the lighting cord is connected.

6 Claims, 18 Drawing Sheets

FIG−9

CONVERSION DEVICE FOR LINKING CORD

BACKGROUND OF THE INVENTION

Field of the Invention

The present invention relates to a conversion device for a linking cord or a linking connector for converting a linking cord that electrically connects linkable LED lighting fixtures together, to a device for connecting linkable LED lighting fixtures to an electric outlet.

Description of the Prior Art

Linkable LED lighting fixtures are presently on the market. Linkable LED lighting fixtures are generally elongated and have inserts at their opposite ends for receiving a linking cable. Commonly assigned U.S. Patent Publication No. 2017/0184284 discloses a linkable LED lighting fixture, and further describes a linking cable, a power cable and a linking connector. The linking cable has at its opposite ends linking plugs, which can be inserted into linking accesses such as orifices at the opposite ends of a linkable LED lighting fixture to link two LED lighting fixtures together. The power cable has an input plug at one end for insertion into an orifice of an appropriate linkable LED lighting fixture and an outlet plug at its opposite ends for insertion into an electric outlet for supplying electrical power to the linkable LED lighting fixture. The linking connector is stated as preferably being rigid, and is inserted into the orifices of a pair of linkable LED lighting fixtures to electrically link or electrically connect them together. Although not prior art, there are on the market interconnect cables for lighting fixtures and under cabinet lighting systems. These cables have insertion plugs on their opposite ends for connecting such under cabinet LED lights. Also on the market, but also not prior art are power cords having one end for insertion into a linkable LED lighting fixture and a plug at its opposite end for plugging into an electric outlet. Even though such products are on the market, there are not known to be any linking devices which can be converted to be used for both linking linkable LED lighting fixtures to each other and for connecting a linkable LED lighting fixture to an electric outlet for supplying electric power to the linkable LED lighting fixture.

BRIEF SUMMARY OF THE INVENTION

An object of the present invention is to provide a linking product which will convert a linking cord for linking a pair of linkable LED light fixtures together to a power cord to provide electrical power from an electric outlet to one or more linkable LED linking fixtures.

Another object of the present invention is to provide an inexpensive yet extremely effective device for converting a linking cord for electrically connecting linkable LED lighting fixtures to each other to a device for transmitting electricity from an electric outlet to a linkable LED lighting fixture.

A still further object of the present invention is to provide a compact and easily storable a device for converting a linking cord for linking electrically a pair of linkable LED lighting fixtures to each other to a linking cord connected at one end to a linkable LED lighting fixture and at the other end to an electrical outlet for supplying electricity to the linkable LED lighting fixture.

A still further object of the present invention is to provide the foregoing device for converting a linking cord for linking linkable LED light fixtures to each other to a power cord, which device can be made inexpensively yet is efficient, safe and effective in use.

These and other objects will be apparent from the description to follow and from the appended claims.

BRIEF DESCRIPTION OF THE DRAWINGS

The foregoing objects are achieved by means of a device referred to it herein as a patch plug which comprises on one end a device for making an electrical connection with a linkable LED lighting fixture, and at its other end an outlet plug for insertion into an electrical outlet for the purpose of supplying electricity to a linkable LED lighting fixture to which the patch plug is connected. The patch plug can be produced in a plastics moulding machine, and can be used easily and effectively.

Objects and advantages together with the operation of the invention, may be better understood by reference to the following detailed description taken in connection with the following illustrations, wherein.

DETAILED DESCRIPTION OF THE PREFERRED EMBODIMENT

Figure 1:
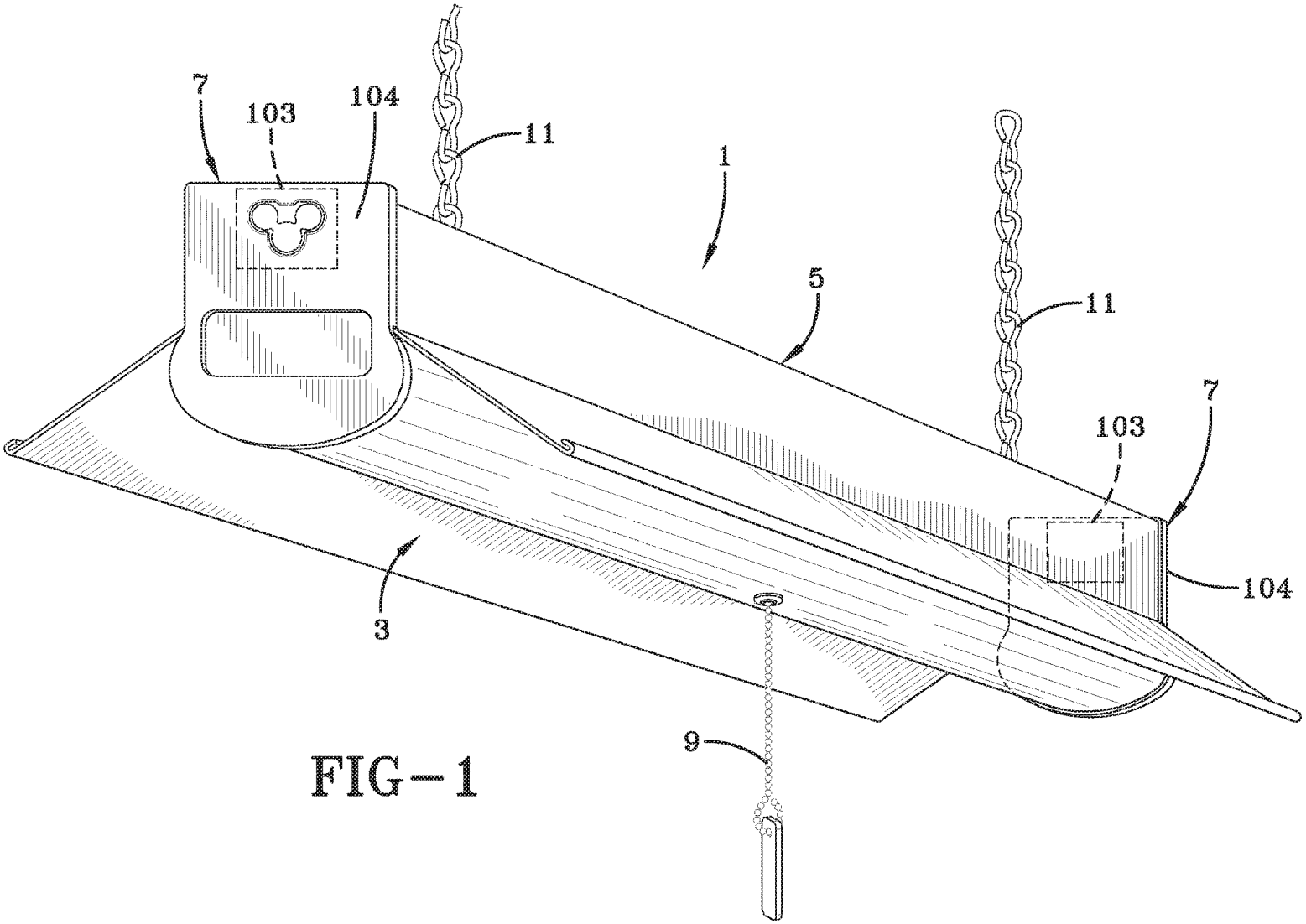
FIG. 1 is a perspective view of a linkable LED shop lighting fixture according to a preferred embodiment of the invention, suspended from metal chains.
Figure 2:
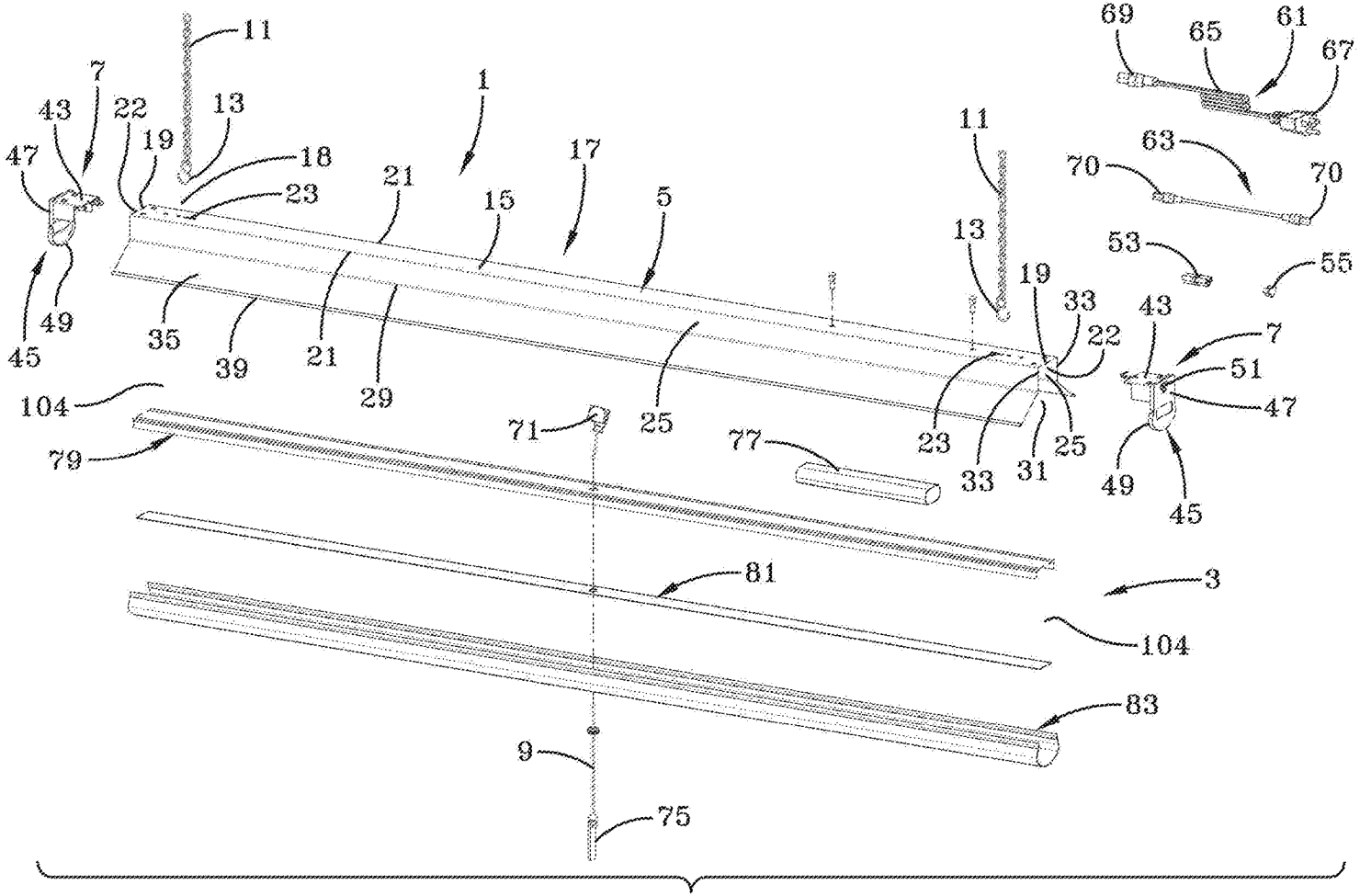
FIG. 2 is an exploded view of some of the components of the LED shop lighting fixture shown in FIG. 1.

The present invention in a preferred embodiment can be used with an elongated linkable LED shop lighting fixture 1 as shown in perspective in FIG. 1. Linkable LED shop lighting fixture 1 includes an LED shop lamp 3, a cover 5 which is preferably made from metal such as aluminum, a cap assembly 7 (there is a cap assembly 7 at either end of cover 5), an on-off chain 9 which is preferably made from an appropriate steel or aluminum. A pair of suspension chains 11 can be provided, which may be made from an appropriate metal such as steel or aluminum from which linkable LED shop lighting fixture 1 would be suspended. On-off chain 9 is a chain for controlling an on-off switch. An exploded view of linkable LED shop lighting fixture 1 is shown in FIG. 2. Cover 5 can be hooked on suspension chains 11 which would be held fast by a ceiling or other upper support structure. Suspension chains 11 have at their respective bottoms a hook 13 for extending through two pairs of chain-holding holes 23 in a rectangular top wall 15 of cover 5.

Cover 5 includes a five sided shade 17 having rectangular top wall 15 which has opposing straight opposing parallel end edges 19, and parallel opposing straight longitudinal edges 21. Shade 17 also has opposite shade end portions 18. Cover 5 further comprises a pair of identical opposing rectangular side walls 25. Side walls 25 have a first pair of opposing parallel longitudinal edges which are connected to and from common longitudinal edges 21 of top wall 15. Side walls 25 further have a second pair of opposing parallel longitudinal edges 29 spaced from said first pair of opposing longitudinal edges 21. Rectangular top wall 15 and opposing rectangular side walls 25 form a three sided cavity 31 in the configuration of a parallelepiped having an open bottom. Cavity 31 is defined at its end by upper end edge which is coincident with straight opposing parallel end edges 19 of top wall 15 and opposing parallel side edges 33 which are also the end edges of side walls 25.

Cover 5 has opposing identical rectangular side flange walls 35. Each flange wall 35 has a pair of parallel longitudinal edges that are the same as the second pair of opposing parallel longitudinal edges 29 of respective side walls 25 and also identified by numeral 29, and a second pair of opposing parallel longitudinal free edges 39. Side flange walls 35 are inclined by equal amounts from parallel rectangular side walls 25 and are symmetrical therewith.

A pair of end cap assemblies 7 cooperates with cover 5 to close the ends of three sided cavity 31. Each end cap assembly 7 comprises an upper flat plate 43 having a width equal to the distance between longitudinal edges 21 of rectangular top wall 15 so that upper flat plate 43 can rest against the underside of top wall 15. Upper flat plate 43 is preferably attached to top wall 15 by means of a single screw with a lock washer, and a pair of resilient tabs (which are plastic when upper flat plate 43 is plastic) for extending through holes near end of top wall 15. End cap assembly 7 further includes an end cover 45 which is flat and extends downwardly from upper flat plate 43 and has an upper rectangular cover portion 47 which closes the respective open ends of three-sided cavity 31, and a lower partially-circular portion 49 having a curved portion for covering the end of LED shop lamp 3 installed within cover 5 as discussed below. Electrical connection to LED shop lamp 3 is preferably made by two pairs of electrical conducting wires extending from a driver discussed below and extending respectively to end cap assembly 7. The electrical conducting wires are attached to a pair of electrically insulated partial embedded orifices forming a part of a set of orifices in respective end cap assemblies 7. More specifically, each end cap assembly 7 includes a set 51 of linking orifices, which is an access for linking connector set 51 preferably has the shape of three overlapping, equiangularly located circles or a trefoil forming the end of three overlapping or partial cylinders for providing access for receiving a linking device such as an electrical input plug 69, a linking plug 70, a linking connector or end-to-end connector 53 or a protective cap 55. Input plug 69 and linking plug 70 are normally identical. Each of the pair of partial embedded orifices has an internal, axial conducting tube which is electrically connected to provide electrical power to LED shop lamp 3. A third axial conducting tube in third embedded orifice is connected to an electrical conducting grounding plate attached to each of end cap assemblies 7. The foregoing conducting members are preferably made of copper. Other forms of electrical connection fall within the scope of the invention. The partial embedded orifices with their conducting tubes are designated broadly as LED lamp electrical contacting structure.

LED shop lighting fixture 1 can include suspension chains 11. A linking device has electrical transmitting plugs, the linking device can take the form of a power cable 61 and a linking cord or linking cable 63. Both are both shown in FIG. 2, and a further device is discussed hereinafter. Power cable 61 includes as its electrical transmitting plugs disposed on an insulated electrical line 65, an electric outlet plug with standard electrical prongs 67 and an electrical lamp fixture plug 69 at the opposite ends of electrical line 65. Electrical lamp fixture inlet plug 69 has three equiangularly-spaced partial tubular inserts. The partial tubular inserts of each of each inlet plug 69, each linking plug 70 and each linking connector 53 described herein have conductive lines made of copper having diameters to receive conductive tubes in the linking orifice in a snug relation to permit proper transmission of electric current. As explained above, the three partial tubular inserts of electrical lamp fixture plug 69 have axial linings made from copper (or other electrical conducting) material and are arranged to make contact with the cylindrical tubes in each end cap assembly 7. Each of the linking devices, i.e. linking connector 53, electrical input plug 69, and linking plug 70 must have appropriate electrical conductor construction to operatively connect with the LED lamp electrically contacting structure. The foregoing electrically conductor construction can be described as linking electricity transmitting structure. In other words, each of linking connector 53, electric input plug 69 and linking plug 70 has three peripherally connected plastic tubes with copper or other electrical conducting sleeves, which when inserted into linking orifice 51 of LED shop lamp 3 (other than a grounding orifice), effects an electrical conducting transmission line with LED shop lamp 3. The linking electricity transmitting structure cooperates with the LED lamp electrically contacting structure transmit electricity between the respective plug and linking connector to another LED lamp or from a power outlet to the respective LED lamp. Power cable 61 is used to supply electric power to LED shop lighting fixture 1, and is accomplished by inserting the prongs of electric outlet plug 67 in an ordinary wall socket and by inserting electrical input plug 69 into linking orifices 51 of end cap assembly 7. Electrical conducting wires from the tubular prongs are connected to a driver 77 discussed below. Linking cable 63 is used to link or connect a pair of linkable LED shop lighting fixtures 1 together so that each of the linked-together linkable LED shop lighting fixtures 1 can be operated individually, so long as electrical outlet plug 67 of power cable 61 is inserted in an electrical outlet and electrical input plug 69 is inserted in linking orifice 51 in an end of the linked together LED shop lighting fixtures 1. Linking cable 63 has linking plugs 70 at its opposite ends, and linking plugs 70 of a linking cable 63 can easily be inserted in linking orifice 51 of adjacent shop lighting fixtures 1 so that the linked in LED shop lighting fixtures 1 can be operated together. Since LED shop lamp 3 and diffuser 83 are elongated, the foregoing fixture is also referred to as an elongated, linkable, LED shop lighting fixture.

In order to activate LED shop lamp 3 held within cover 5, a switch 71 is provided. Switch 71 is included in the electrical circuit that includes the foregoing shop lamp 3 as discussed hereinafter. On-off chain 9 is attached to switch 71, and it includes tags 75 for identifying linkable LED shop lighting fixture 1.

Figure 6:
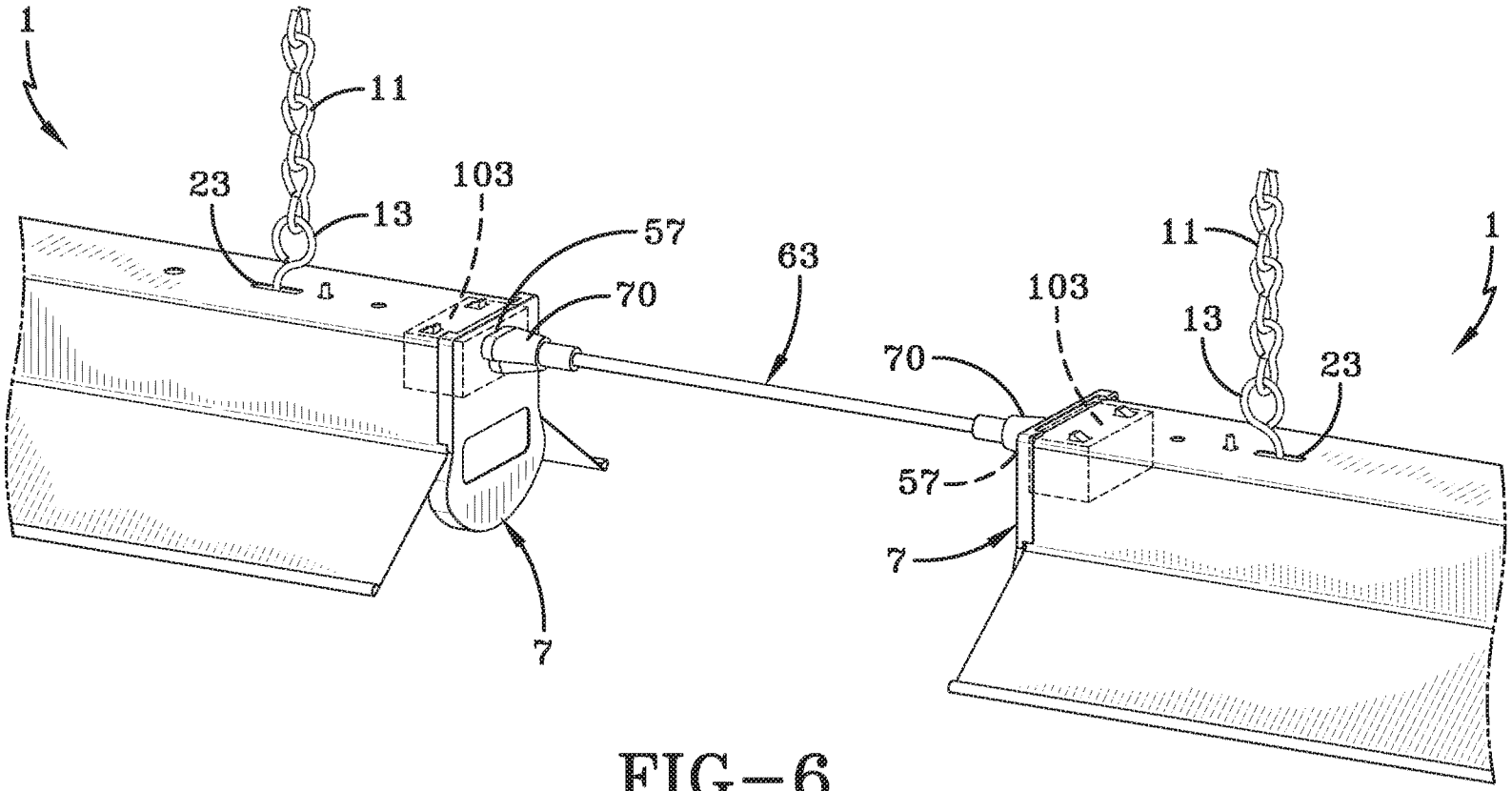
FIG. 6 is a partial perspective view of a linkable LED shop light system incorporating a pair of linkable LED shop lighting fixtures of the type incorporated in the linkable LED shop lighting fixtures shown in FIG. 2, connected together by a linking cable.

LED shop lamp 3 includes driver 77, a heat sink 79, an LED module 81, diffuser 83, and electrical conductors for transmitting electrical current to lamp 3. Driver 77 is used to provide electrical power in the correct form to LED shop lamp 3. Electrical conducting wires are connected to LED module 81. Heat sink 79 is provided for absorbing and transmitting heat generated by LED module 81 when shop lamp 83 is illuminated. LED module 81 is provided adjacent heat sink 79. LED module 81 comprises LED chips that are mounted on a printed circuit board that use surface-mounted technology. Finally, diffuser 83 is provided in part for containing driver 77, heat sink 79 and LED module 81. Diffuser 83 spreads the illumination from LED module 81 in a desired pattern, which essentially directs most of the illumination downwardly to the space to be illuminated. LED shop lighting fixture 1 further includes end connectors 103 shown in FIGS. 1 and 6 schematically (but which can be of any appropriate type including those in the known art) at a LED shop lamp end portion 104 of end cap assembly 7 through which electrical connection can be made with LED shop lamp 3.

Figure 3:
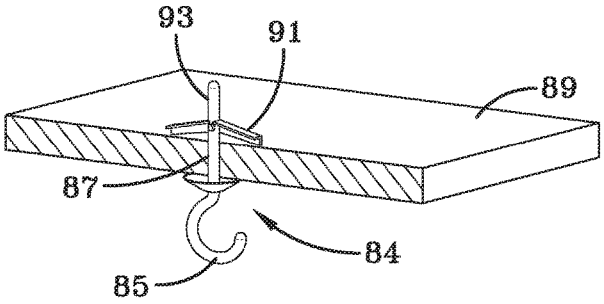
FIGS. 3-5 show components of a linkable LED shop lighting fixture according to a preferred embodiment of the invention being installed from on a drywall and from a ceiling.
Figure 4:
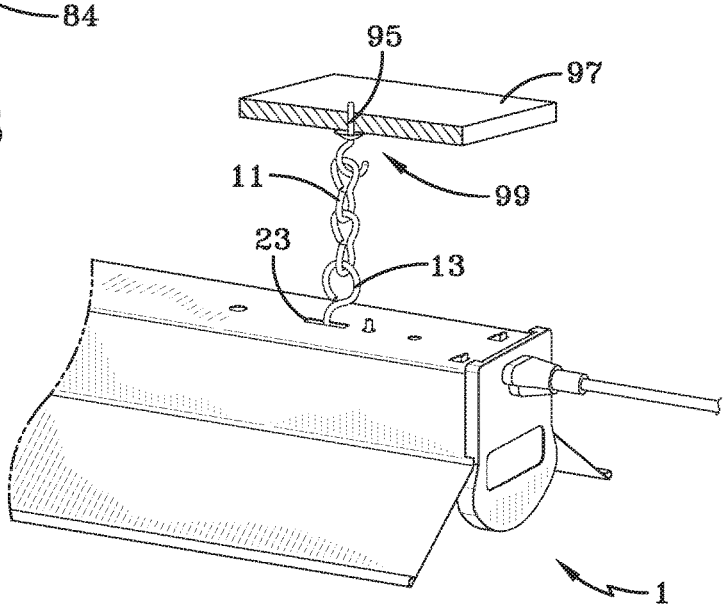
Figure 5:
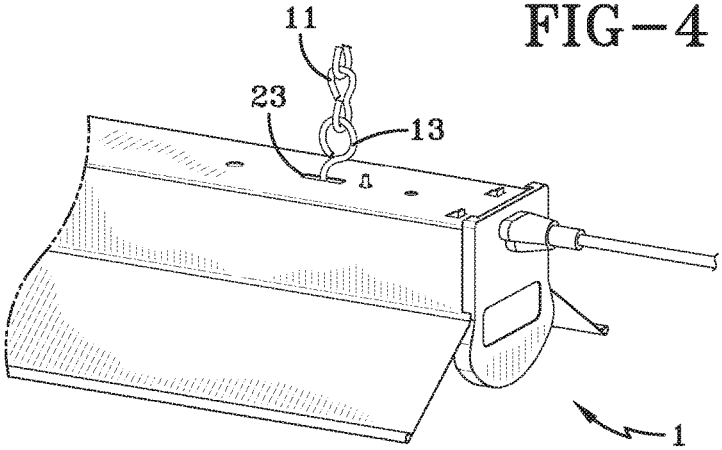

Linkable LED shop lighting fixture 1 is very easy to install. In order to install shop lighting fixture 1 to a drywall ceiling 89 as shown in FIG. 3, the installer uses a toggle bolt 84 with a toggle bolt hook 85. A small hole 87, which should be around ¼", is drilled in drywall ceiling 89. The installer inserts a bolt 93 through hole 87 with a pair of flaps 91 in a folded position until flaps 91 are on the upper part of drywall ceiling 89, at which time they open up as shown in FIG. 3. Toggle bolt 93 is then tightened. If a wood ceiling is used, the installer would drill a small hole 95 into a wood ceiling 97 as illustrated in FIG. 4 and install a bolt hook 99 therein. In either case, hook 13 at the lower, free end of suspension chains 11, is inserted through each pair of chain holding holes 23 as shown in FIGS. 4 and 5. In this manner, shop lighting fixture 1 is easily installed in either of ceilings 89 or 97.

There are two ways depicted in which adjacent linkable LED shop lighting fixtures 1 can be linked to another LED shop lighting fixture together to form an LED shop lighting system 100. With reference to FIG. 6, linking cable 63 is used to link together LED shop lighting fixtures 1. It can be seen that the two linking plugs 70 are inserted in linking orifices 51 (shown in FIG. 2) extending through the respective end cap assemblies 7 at the adjacent ends of LED shop lighting fixtures 1. Linking cable 63 is flexible, and linkable LED shop lighting fixtures 1 do not have to be in alignment as they are shown, but could be at an angle relative to each other could be at different distances from the ceiling and need not be parallel to each other. Furthermore, linking cable 63 can be held taut as shown in FIG. 6, but can also have some slack in it as well.

Figure 20:
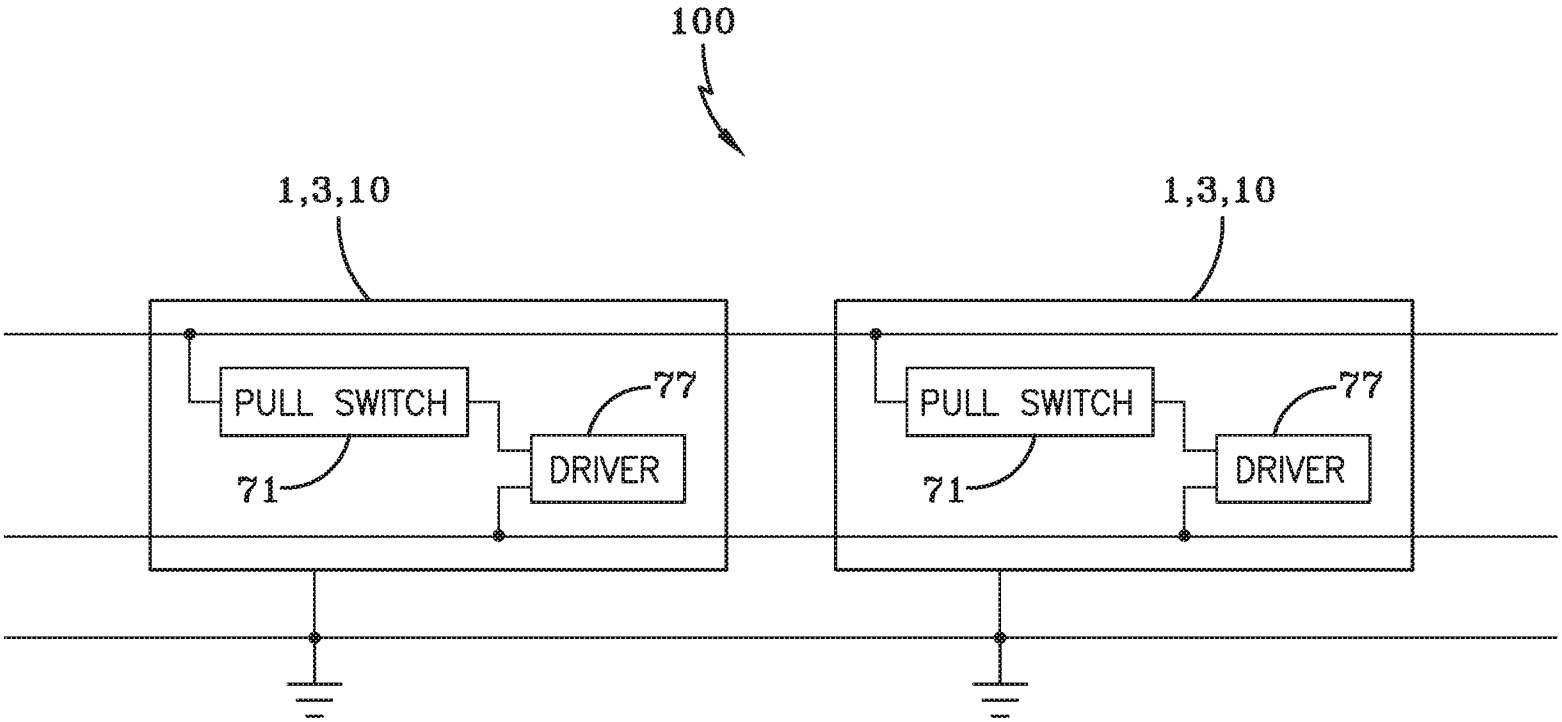
FIG. 20 is an electric circuit diagram showing the switching arrangement for a linkable LED shop lighting system according to a preferred embodiment of the invention.

Reference is made to FIG. 20 showing the electrical connection of a pair of LED shop lamps 3 in LED shop lighting fixtures 1 to form an LED shop lighting system 100. Two LED shop lamps 3 in LED shop lighting fixtures 1 are linked together. Switch 71 is connected in series with driver 77 in each of the pair of LED linked shop lighting fixtures 1 including LED shop lamps 3. Each circuit is connected to ground. Each LED shop lamp 3 has a pull switch 71 for operating driver 77 or for deactivating driver 77. Each pull switch 71 can thus be operated to activate the respective LED lamps 3 to turn them on or off. Modifications can be made for switching apparatus to activate or deactivate all of the LED light lamps simultaneously.

Figure 7:
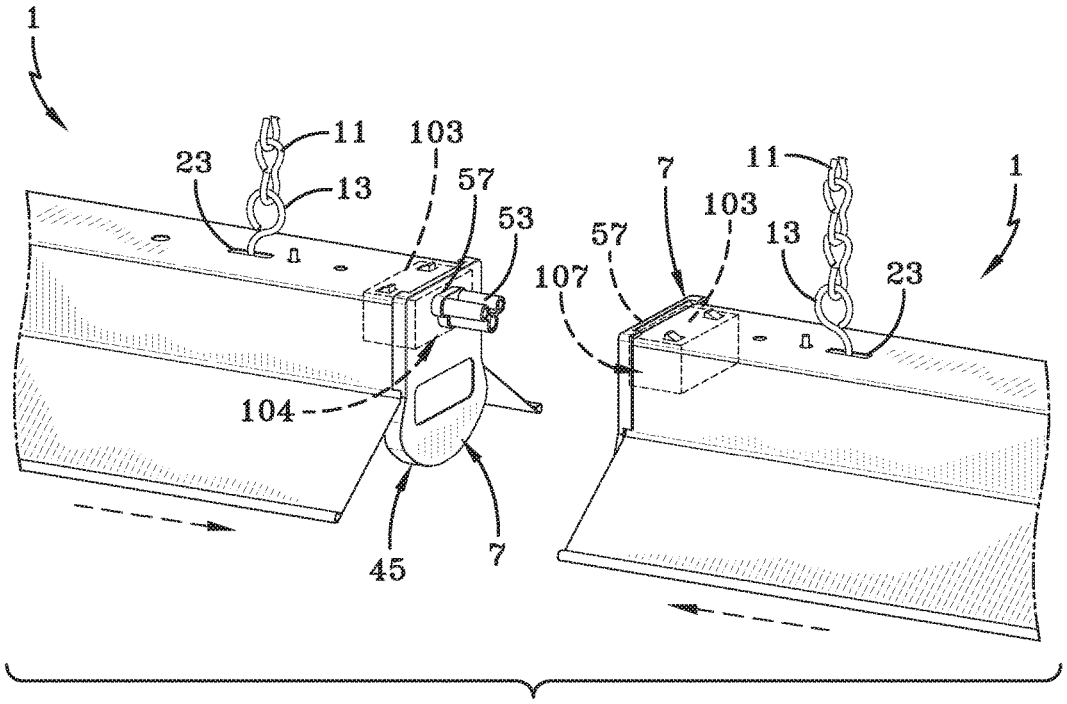
FIGS. 7 and 7A are partial perspective views of a linkable LED shop lighting system composed of a pair of LED shop lighting fixtures about to be and then connected together by a rigid connector.
Figure 7A:
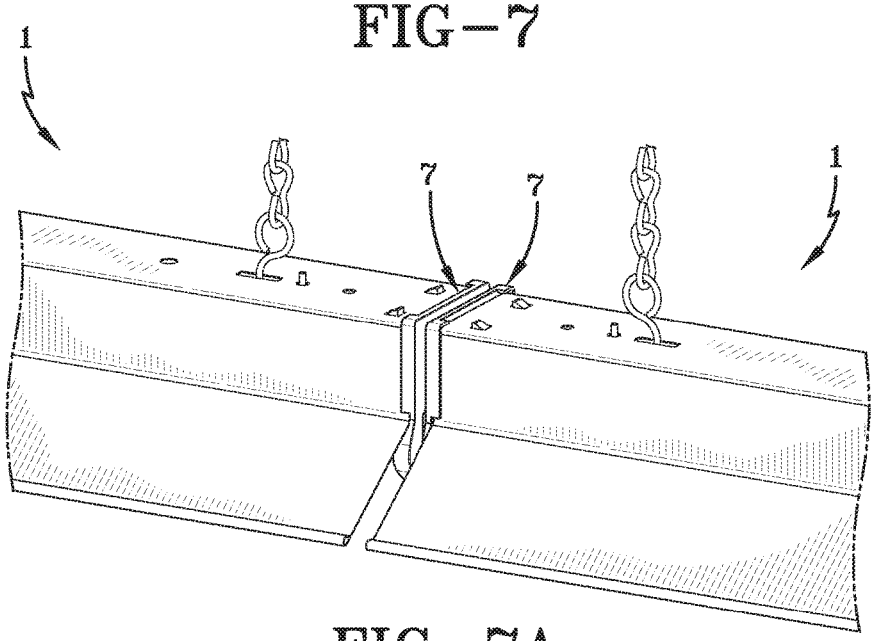

Referring to FIGS. 7 and 7*a*, linking connector 53, which is preferably rigid, is shown installed into linking orifices 51 of one linkable LED shop lighting fixture 1 and positioned for insertion into linking orifice 51 in the adjacent linkable LED shop lighting fixture 1. Once linking connector 53 is installed in both linking orifices 51 and linkable LED shop lighting fixtures 1 are urged together as shown in FIG. 7*a*, shop lighting fixtures 1 are firmly connected together as shown in FIG. 7*a*, and their respective end piece covers 45 either engage each other or are very close to such engaging. Linking connectors 53 could be long, yet still make the electrical connection with each other. Linking connector 53 is preferably short, about an inch and a quarter (1¼ inches) in length, but it could be of any length. Linking connector 53 is preferably symmetrical at both ends, and two sets of three connected cylindrical tubes extend linearly, each set being directed in opposite directions. Each tube has an open free end. There are copper or other electrical conducting tubular sleeves for engaging electrical conductors in each of a pair of orifices of set 51 in which the respective cylindrical tubes of lining connector 53 inserted in linkable LED shop lighting fixtures 1. The sleeves thus contact the axial tubular extensions of the tubular sleeves in end cap assembly 7. When end cap assembly 7 has set 51 of three linking orifices, each linking connector 53 is likewise equiangularly-spaced to be inserted into end cap assemblies 7. The connected cylindrical tubes of linking connector 53 have a trefoil orientation. Thickened band 57 of linking connector 53 (FIG. 7) is provided at the midsection of linking connector 53 which acts as a shoulder for engaging the surface around the respective linking orifices 51 to limit the insertion of linking connector 53 into each end cap assembly 7.

Any number of linkable LED shop light fixtures 1 can be linked together using either linking cables 63 or linking connectors 53. One power cable 61 is used in order to energize a single LED shop lighting fixture 1 or a series of LED shop lighting fixtures 1 that are linked together. Each of system of linked together LED shop lighting fixtures 1 can be operated independently by means of the actuation of switch 71 by means of a chain by simply pulling the chain to turn the respective linkable LED shop lighting fixtures 1 on and off.

Figure 8:
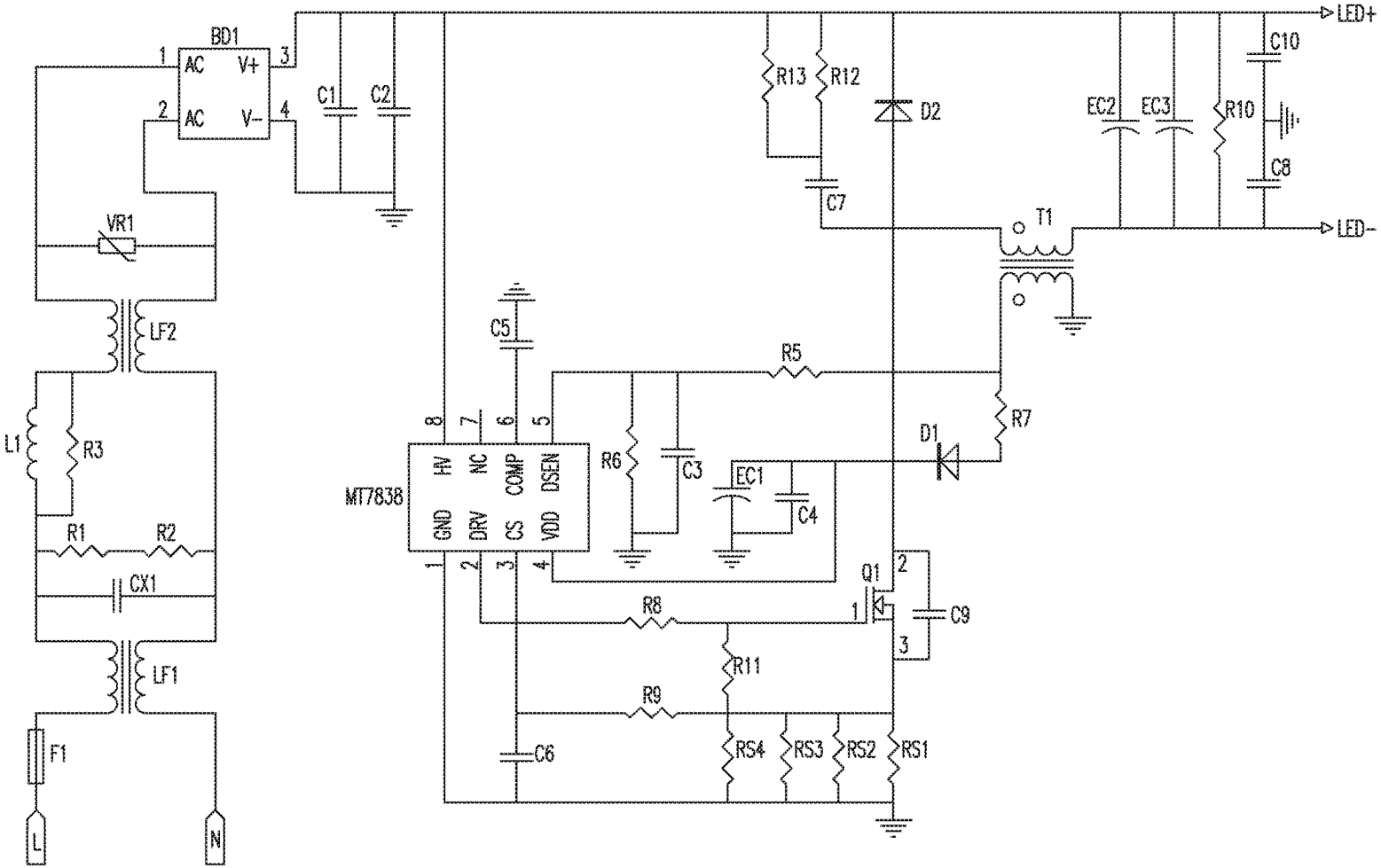
FIG. 8 is a circuit diagram of the electrical components for use in the linkable LED shop lighting fixture shown in the preceding figures.

A circuit diagram 101 for linkable LED shop light fixture 1 is shown in FIG. 8. There is a pair of inputs L and N with a fuse F1 in series with input L which are connected to a transformer LF1 to which is connected a circuit component including a capacitor CX1 which is parallel with resisters R1 and R2. Also in this circuit component is an inductor L1 connected in parallel with a resister R3. Another transformer LF2 is connected to a circuit component having a variable resister VR1 which is in turn connected to an AC/DC converter BD1. The output of the latter, V+ and V− connected across a pair of capacitors C1 and C2. These are in turn connected to a circuit having a control component. Components C1-C10 are capacitors. D1 and D2 are diodes. The component labelled MT7838 is a single-stage buck average constant current controller. T1 is a transformer which is connected to the ground. BD1 is a current compressor and VR1 is a voltage reducer. The bridge having capacitors C1 and C2 are connected to ground, as are capacitor C5 and the circuit including RS1-RS4, C6 and R9. EC1-EC4 are polarized capacitors.

Figure 9:
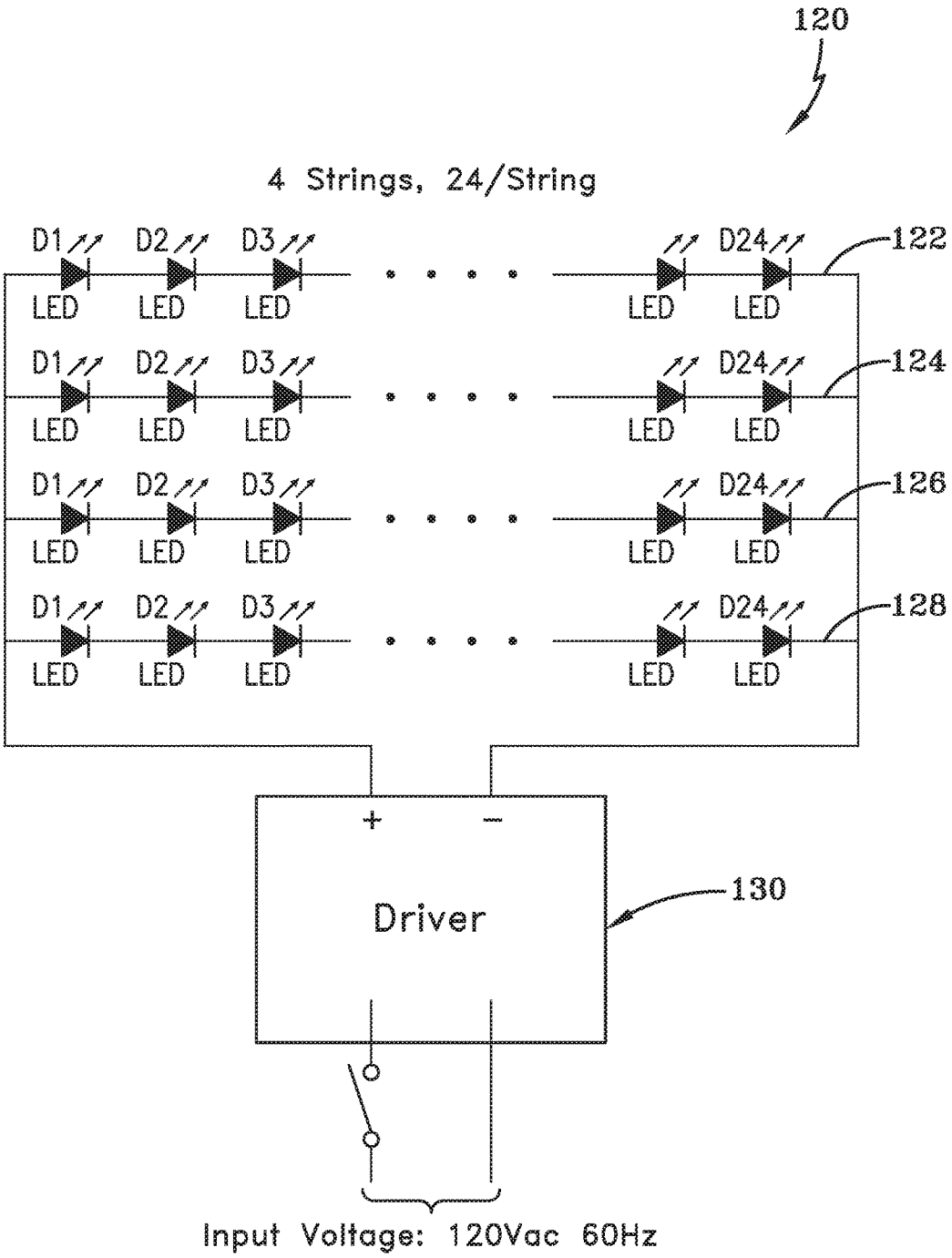
FIG. 9 is a circuit diagram for the electrical components of a LED shop lamp shown in some of the preceding figures with a driver.

Referring to FIG. 9, an LED strip circuit 120 is shown. Strip circuit 120 has four strings 122, 124, 126 and 128, each having twenty four LEDs. These are powered by a driver 130.

Figure 10:
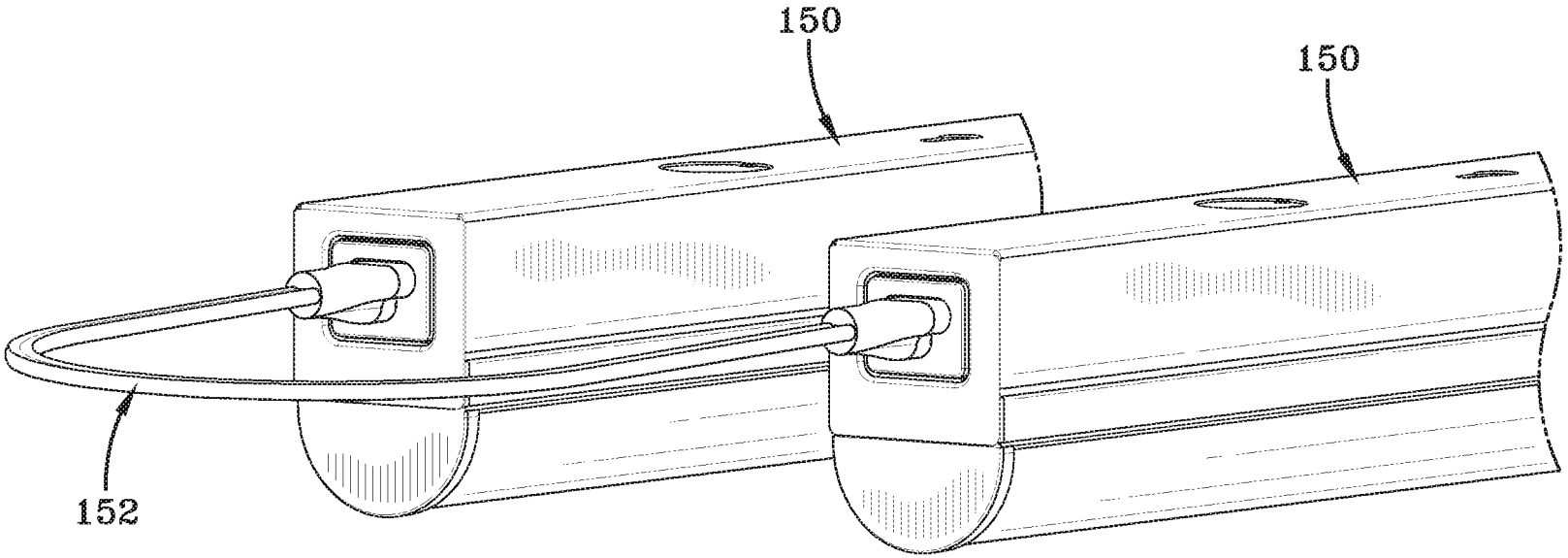
FIG. 10 is a perspective view of a portion of a linkable LED string lighting system according to an embodiment of the invention incorporating a pair of linkable LED strip lighting fixtures that are linked together.

Referring to FIG. 10, a pair of respective linkable LED strip light fixtures 150 is shown which are connected by a linking cable 152. A series of LED strip light fixtures 150 can be connected together for a virtual unlimited number of linkable LED strip light fixtures 150 by means of sequential linking cables 152. A power cable would be required to connect an end of LED strip light fixtures 150 to a power source.

Figure 11:
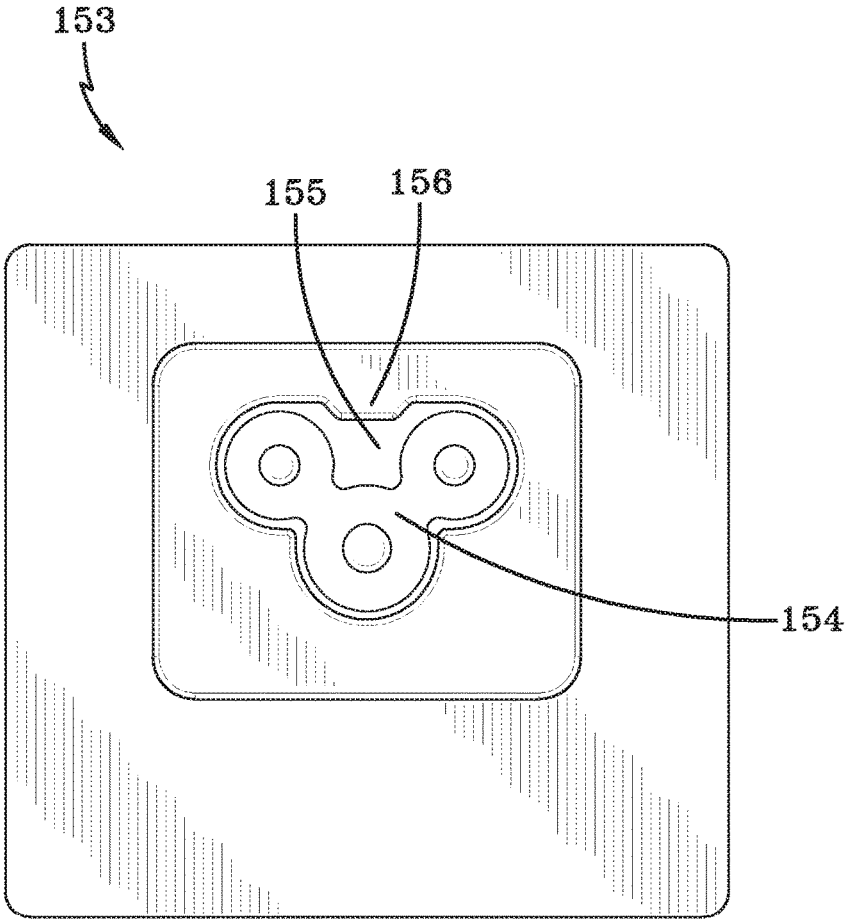
FIG. 11 is an end view of one of the linkable LED strip lighting fixture of the type shown in FIG. 10 with an installed protective cap.

Referring to FIG. 11, an end view of a linkable LED strip lighting fixture 153 is shown. An end connector or linking opening 155 (discussed below) in which a linking plug (discussed below) is to be inserted should be protected when not in use. Therefore, a protective cap 154 having a trefoil configuration, which is the same configuration as that leading to the end connector opening, is used to protect the end connector opening 155. Protective cap 154 has a depression 156 into which an implement can be inserted for removing protective cap 154 from the end connector opening.

Figure 12:
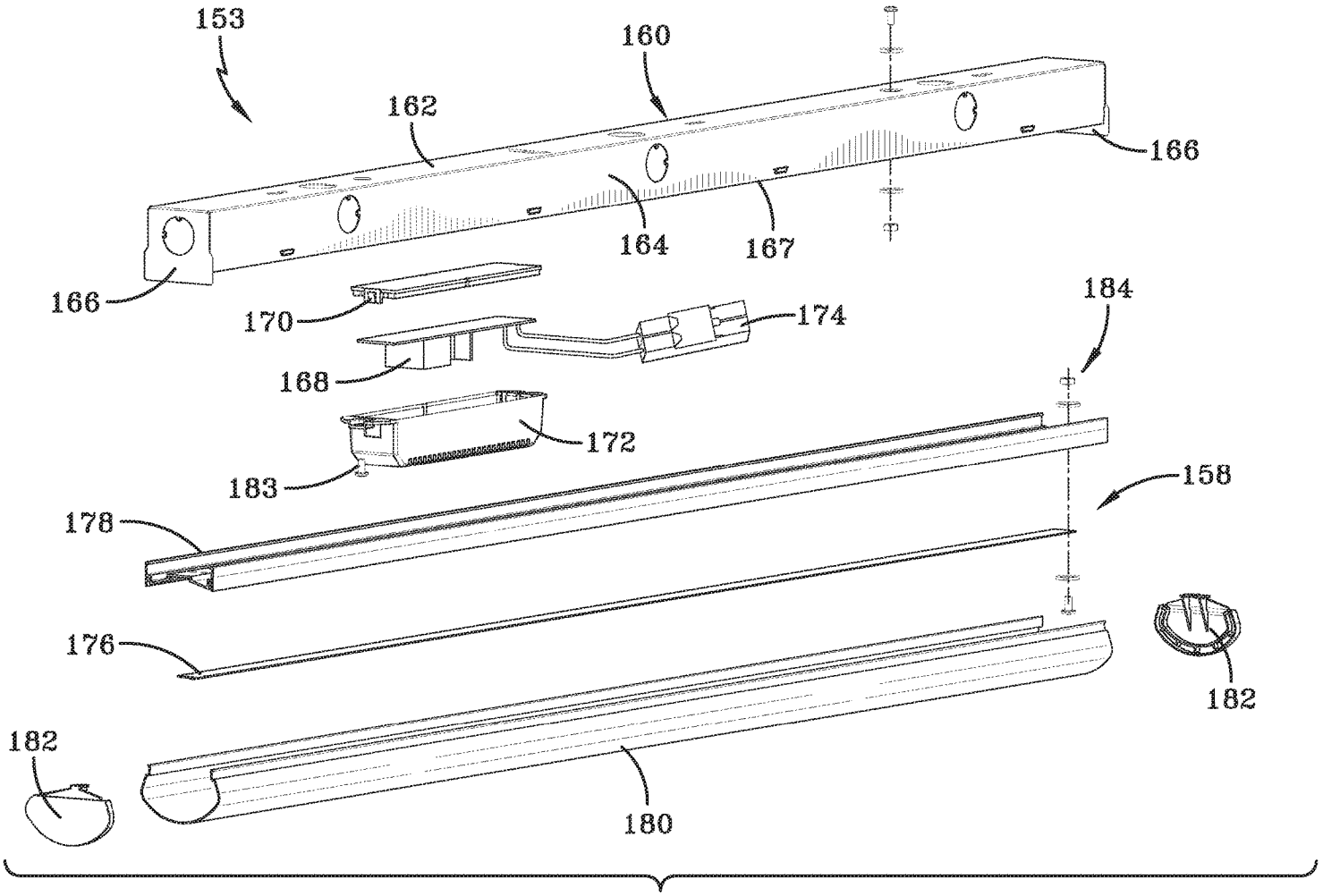
FIG. 12 is an exploded view of one of the linkable LED strip lighting fixtures as incorporated in the system shown in FIG. 10.

An exploded view of one form of linkable LED strip lighting fixture 153 is shown in FIG. 12. Linkable LED strip lighting fixture 153 includes a housing 160 which comprises a top piece 162 and a pair of parallel, opposing, and elongated side walls 164 with a pair of opposing end pieces 166 which are mounted across the coplanar parallel ends of top piece 162. Side walls 164 have elongated, side wall bottom edges 167.

LED strip lighting fixture 153 includes an LED strip lamp 158 which includes a driver 168 above which is a driver box bottom 170. Driver 168 fits inside a driver box top 172 and driver box bottom 170 to be enclosed therein. A power plug 174 is provided for attachment to driver 168 for transmitting electric power thereto.

An LED module 176 is an elongated member having a plurality of strips of LEDs included therein. A heat sink 178 which is of about the same length as LED module 176, and it is provided for absorbing the heat generated by LED module 176. Also attached to housing 160 is a diffuser 180 which receives LED module 176 and heat sink 178, and which is clipped to the bottom of housing 160. Diffuser 180 diffuses illumination from LED module 176 in a generally downward direction.

A pair of end covers 182 clips onto the ends of diffuser 180 to protect the interior of diffuser 180 and the parts that it encloses, from contaminants in the ambient air.

A screw assembly 183 is used for attaching driver box top with driver 168 and driver box bottom 170 to housing 160. Screw, washer and nut assembly attach the illumination components including diffuser 180, LED module 176 and heat sink 178 to housing 160.

Figure 13:
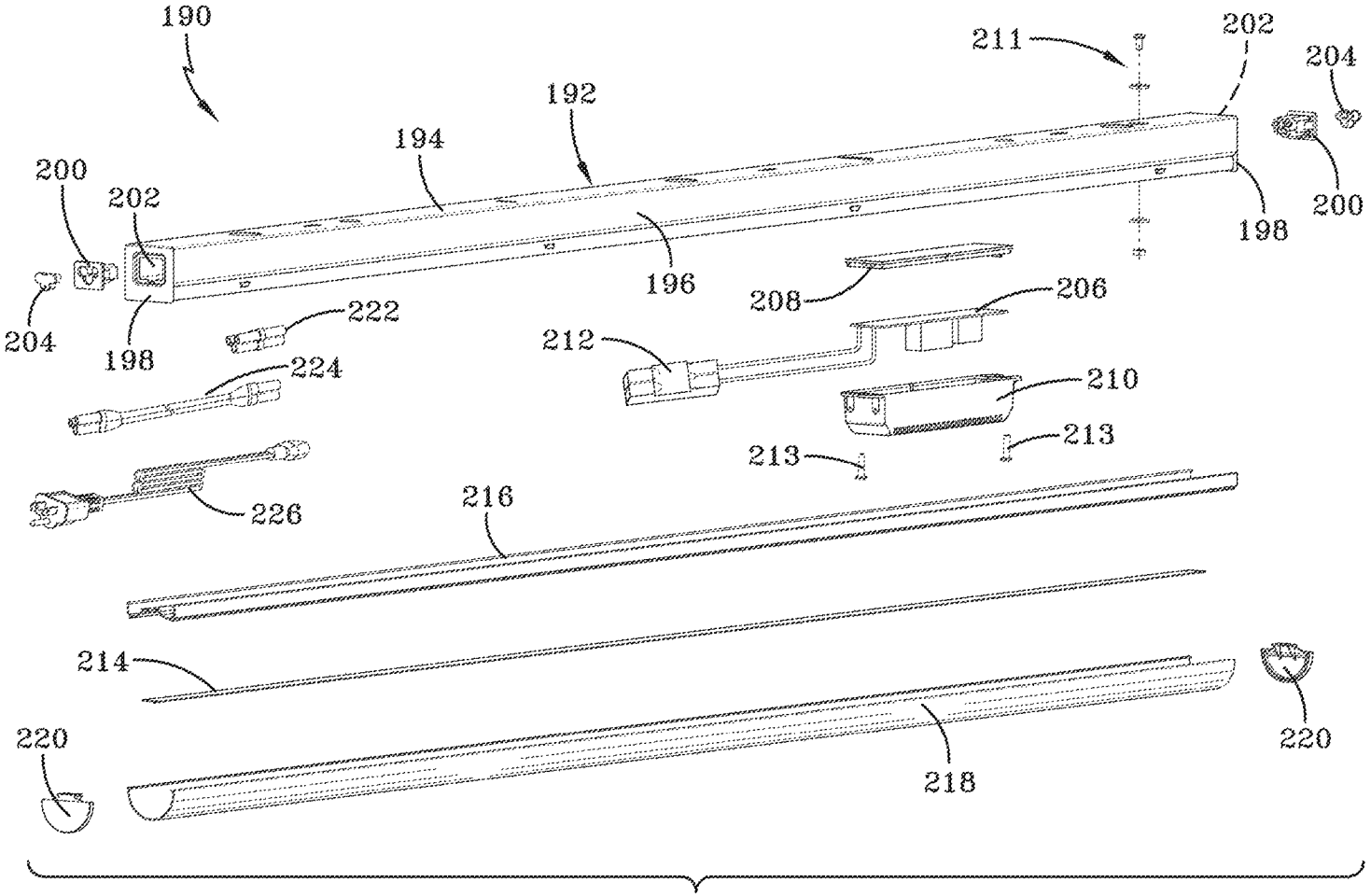
FIG. 13 is an exploded view of another version of a linkable LED strip lighting fixture according to a preferred embodiment of the invention.

Another size of an LED strip light fixture is shown in FIG. 13. Referring to FIG. 13, a linkable LED strip lighting fixture 190 is shown. LED strip lighting fixture 190 includes a cover or housing 192 having a top wall 194, and extending downwardly from its opposing parallel edges is a pair of side walls 196, to form three walls of a rectangular parallelepiped having an open bottom opposite top wall 194. Housing 192 has a pair of end pieces 198 which are disposed at the opposite ends of housing 192. Connecting seats 200 are disposed in apertures 202 in respective end pieces 198. Connecting seats 200 have a trefoil-shaped opening for receiving a linking plug, and electrical input plug or a protective cap 204 for the protection of the interior of connecting seat 200, when a plug is not installed therein. A linking cable or linking cord 224 similar to linking cable 63 or a linking connector 222 similar to linking connector 53 discussed with respect to linkable LED shop light fixture 1 are provided. Reference is made to the discussion regarding linking connector 53 for a description of linking connector 222. A power cable or power cord 226 is similar to power cable 61 is required when fixture 190 is to be turned on for illumination. Reference is made to the discussion of power cable 61 for the description of the components of the electric input plug and the outlet plug included in power cable 226.

The following parts are those from known strip light fixtures. These include a driver 206, a driver box bottom 208, a driver box top 210 and a screw assembly 211 for attaching driver box top 210 to driver box bottom 208 for enclosing driver 206. A power plug 212 is also provided for power for driver 206. Screws 213 attach driver box bottom 208 to driver box top 210 to enclose driver 206. Strip lighting fixture 190 further includes an LED module 214, a heat sink 216, a diffuser 218 and a pair of opposing end covers 220.

Figure 14:
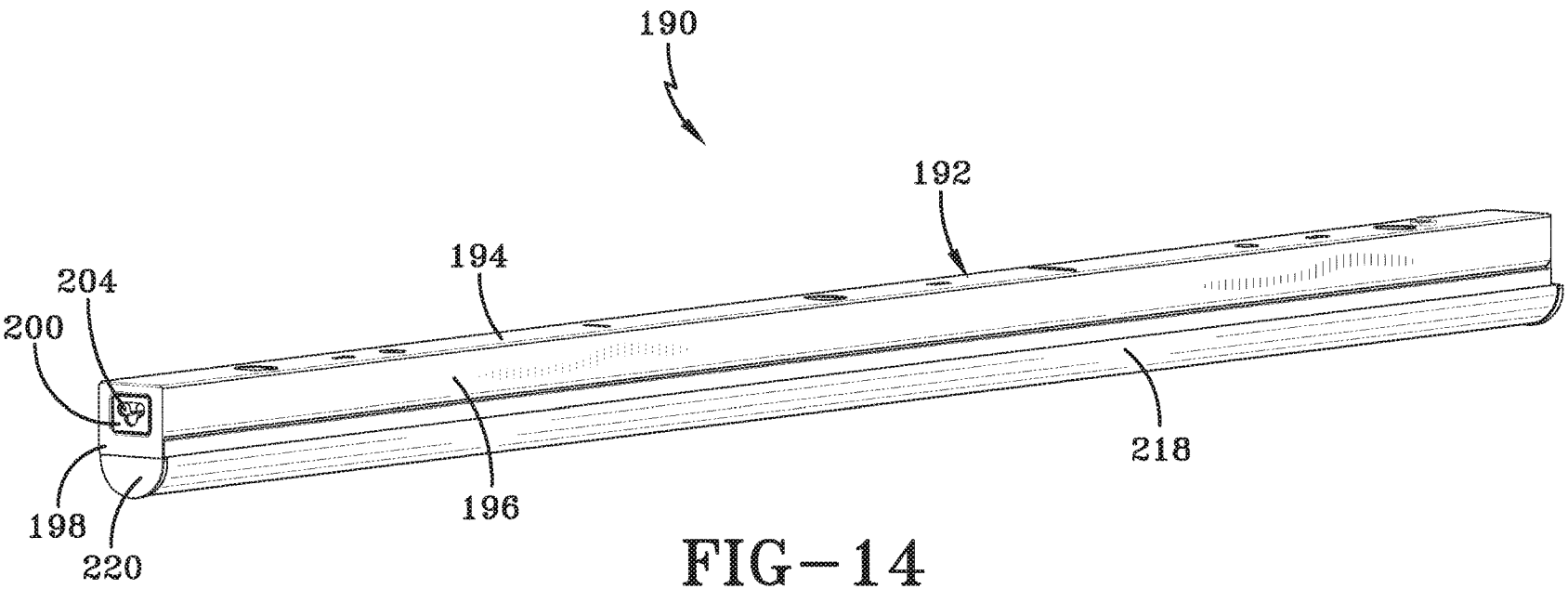
FIGS. 14-18 are respective perspective, top, front, end and bottom views of the subassembly of a linkable LED strip lighting fixture according to an embodiment of the invention shown in FIG. 13.

Drawings of the entire strip light assembly 190 are shown in FIGS. 14-18. FIG. 14 shows LED strip lighting fixture 190 in perspective form. Shown in FIG. 14 are housing 192 with top wall 194 and side wall 196, end piece 198 having inserted therein connecting seat 200 with protective cap 204. Located between end covers 214 is diffuser 218.

Figure 15:
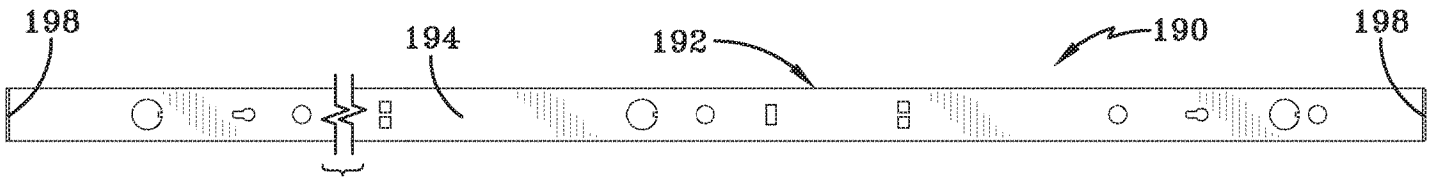
Figure 16:
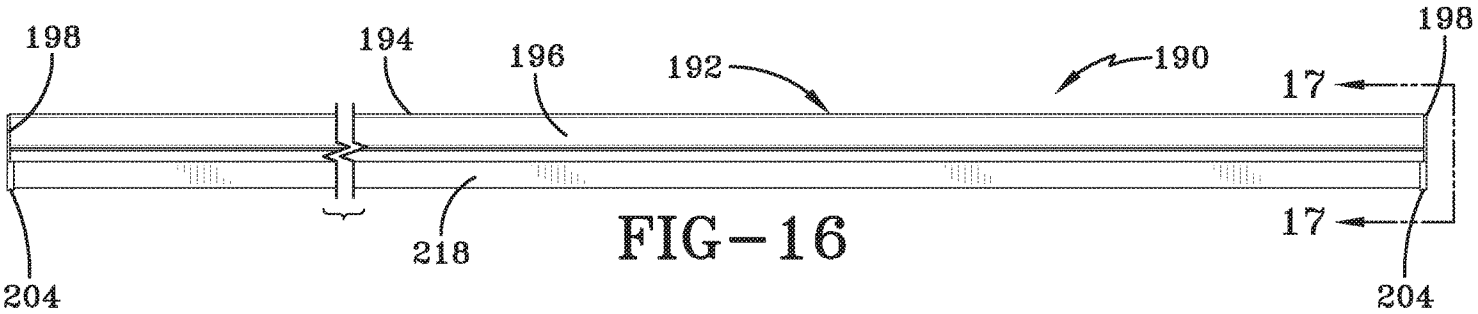
Figure 17:
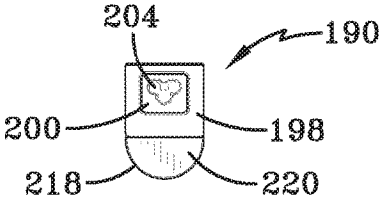
Figure 18:
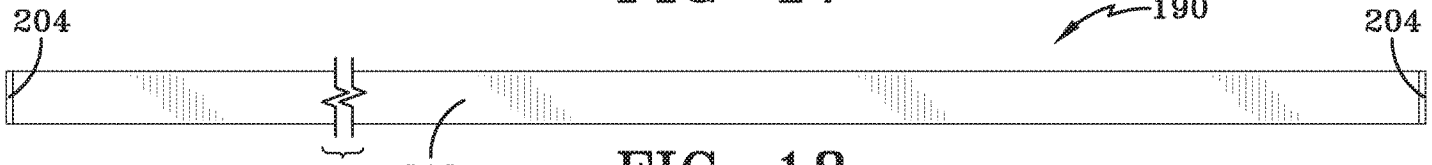

FIG. 15 shows a top view of linkable LED strip lighting fixture 190 in which can be seen top wall 194 of housing 192. A front view of LED strip lighting fixture 190 is depicted in FIG. 16. Housing 192 is shown on which side wall 196 is visible. The lower portion of LED strip lighting fixture 190 is diffuser 218. The end view of LED lighting fixture 190 is shown in FIG. 17. End cover 220 is shown below end piece 198 in which are located connecting seat 200 in which is located protective cap 204. Referring to FIG. 18, the bottom view of LED strip lighting fixture 190 shows diffuser 218 between protective caps 204.

Figure 19:
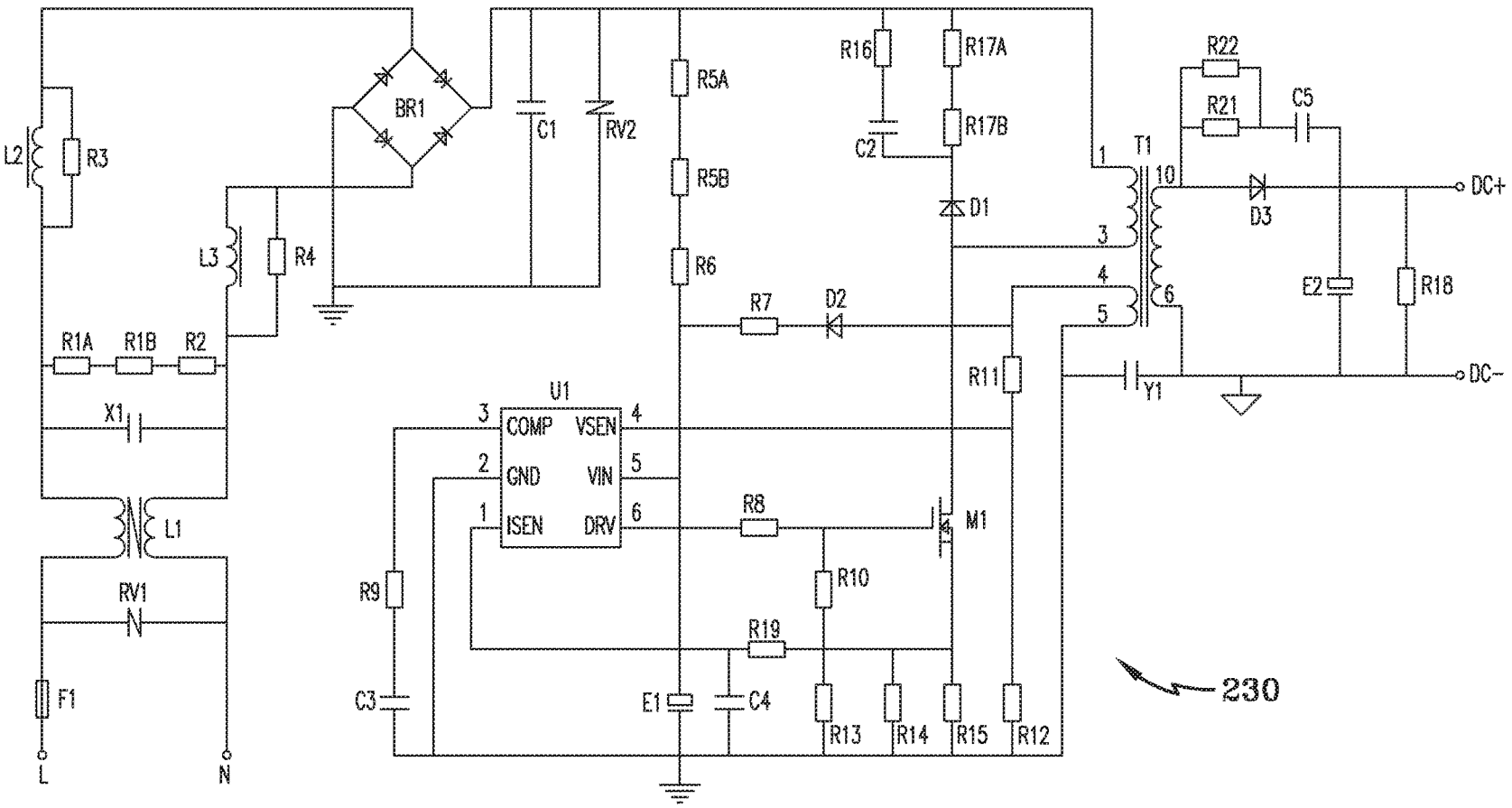
FIG. 19 is an electric circuit diagram of the electrical components included in the linkable LED strip lighting fixture shown in FIGS. 10-13.

Referring next to FIG. 19, a circuit 230 is shown for the electric circuitry of linkable LED strip light fixtures 150 and 190. Circuit 230 includes inputs L and N, a fuse F1 connected in parallel with a voltage variator RV1, and the latter are connected to a variable inductor L1. These are connected to a circuit for output smoothing, which includes a capacitor X1, resistors R1A, R1B and R2, the latter of which are connected in series and in parallel with capacitor X1. Also included in the smoothing circuit are resistor R3 which is connected across inductor L2 and resistor R4 which is connected across inductor L3. Included in the smoothing circuit is a diode bridge BR1. BR1 is connected in parallel with a capacitor C1 and a variable capacitor RV2. Another circuit connected to the previously discussed circuits includes three resistors R5A, R5B and R6 which connected in series, and in parallel with a diode D2 and a resistor R7. Further in the latter circuit are a resistor R16 connected in series with a capacitor C2, connected in parallel with resistors R17A and R17B, the latter connected in series. A transformer T1 is connected across the latter circuit including diode D1 and another circuit having a positive direct current and negative direct current terminals. Lines 4 and 5 which are connected to transformer T1 run in parallel and resistors R11 and R12 are connected in line 4. Between the line connecting R11 and R12 is a line connected across a control circuit U1. A semiconductor control component M1 is connected in parallel with resistors R10 and R19, and in parallel with parallel conductors R13, R14 and R15 as well as capacitor C4.

Figure 21:
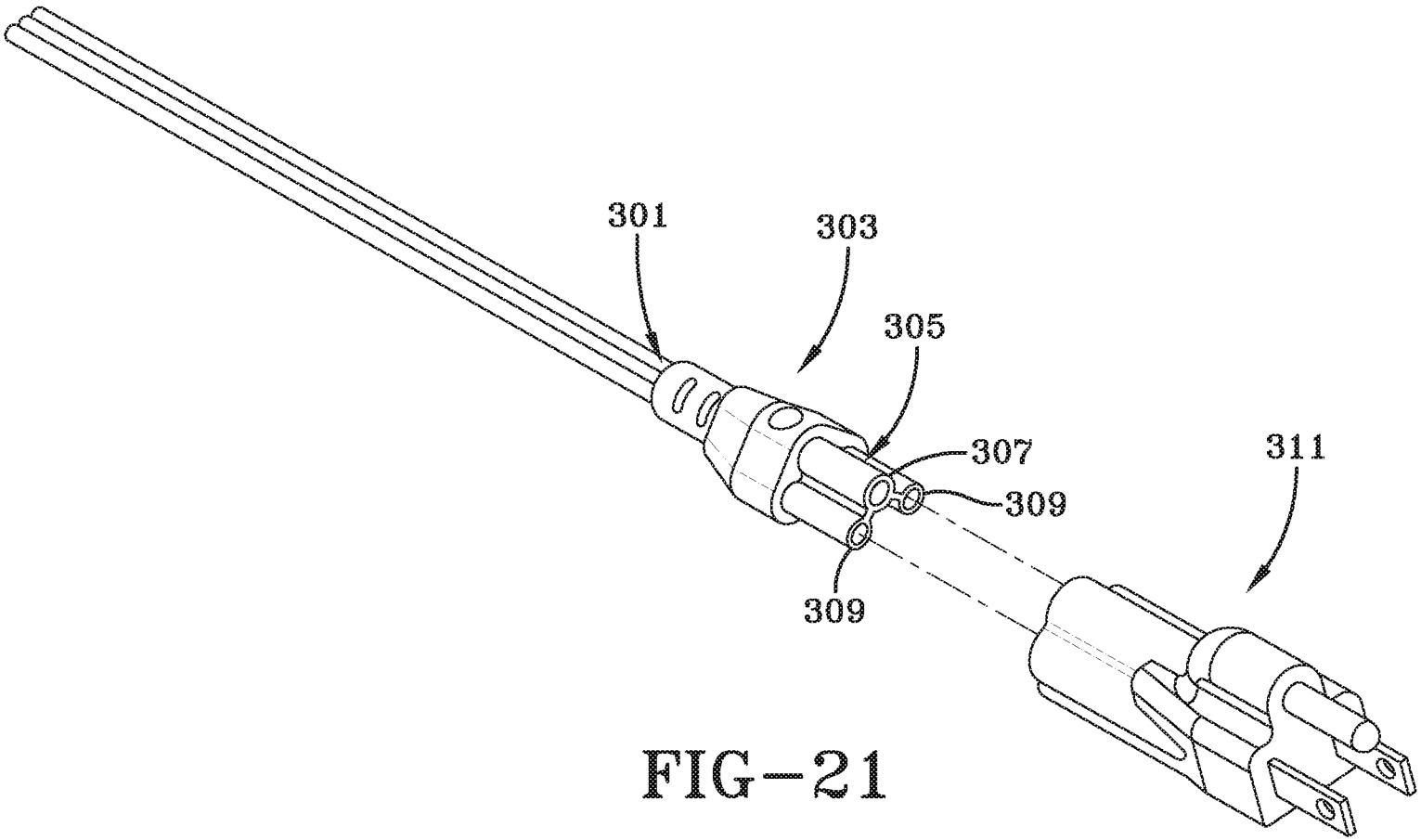
FIG. 21 is a perspective view of a linking cable and a patch plug according to the preferred embodiment of another aspect of the present invention.

Linking cables 63 and 224, linking connectors 53 and 222, and power cables 61 and 226 have been described above. A variation renders a power cable unnecessary. Reference is first made to FIG. 21. A linking cable or linking cord 301 is shown. Linking cord 301 is essentially the same as linking cable or linking cord 63, or linking cable or linking cord 224. It has been found to be advantageous for linking cord 301 to be about five feet in length. Linking cord 301 has at its opposite ends a linking plug 303 (only 1 is shown) similar or identical to input plug 69, linking plugs 70 and the corresponding plugs on linking cable 224 and power cable 226. Linking plug 303 is constructed virtually identically with input plug 69, linking plugs 70 and the corresponding plugs on linking cable 22 and power cable 226. Thus, linking plug 303 has a linking electricity transmitting structure 305 depicted in this embodiment as including a relatively large female tubular connector 307, and two other relatively small but equal-sized female tubular connectors 309. Connectors 307, 309 have copper or other electrically conductive linings that are connected to the respective conductive wires in linking cable 301.

Figure 22:
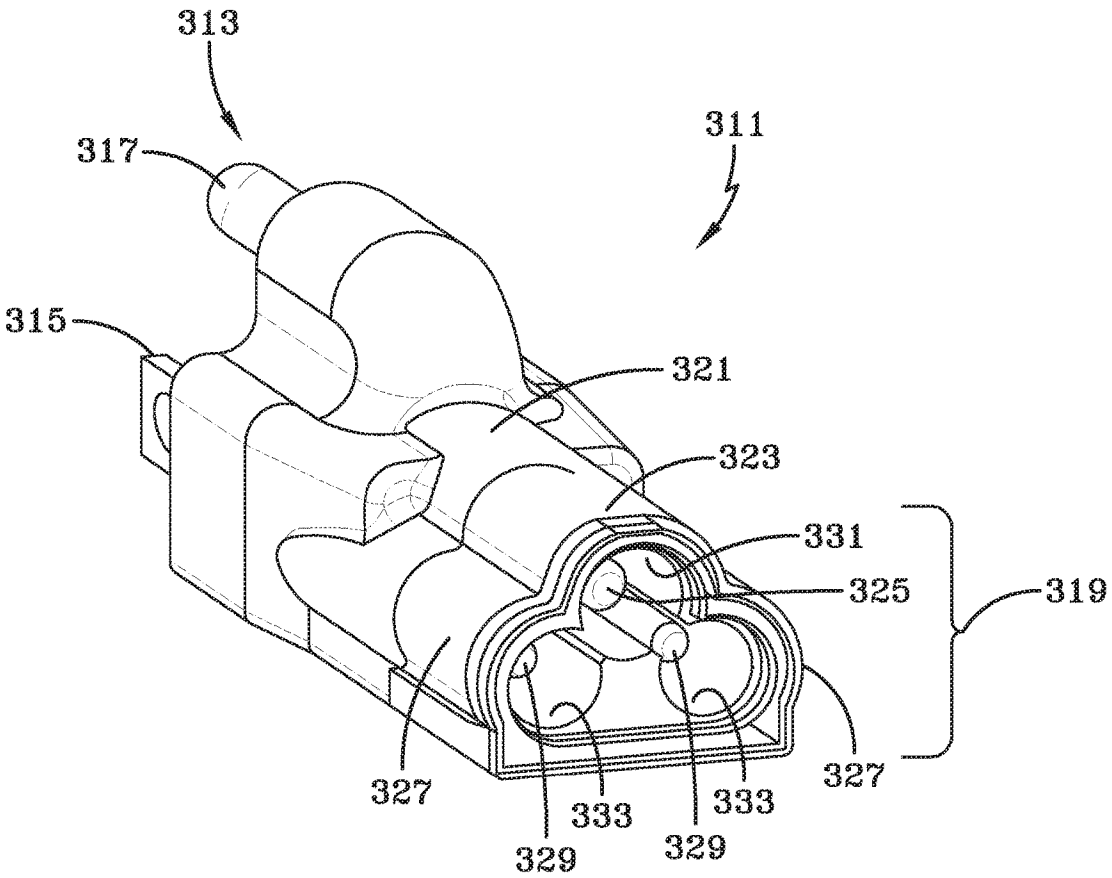
FIG. 22 is a perspective view of one end of the patch plug shown in FIG. 21.
Figure 23:
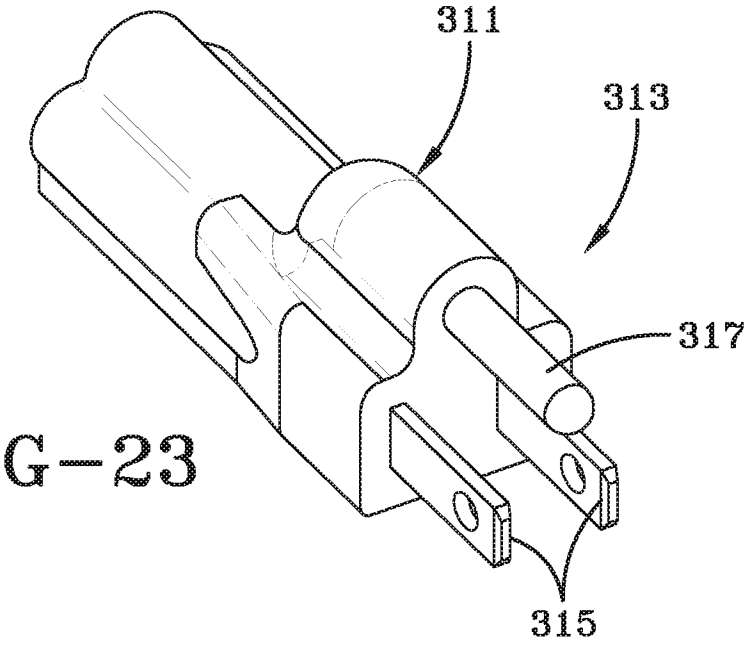
FIG. 23 is a perspective view of the opposite end of the patch plug shown in FIG. 21.

When two LED linkable light fixtures such as LED shop light fixture 101, LED strip light fixtures 153 or LED strip light fixture 190 are to be linked together, an insulated cable is placed between the two fixtures and linking plug 303 from either end of the cable is inserted into the appropriate connection such as end connectors 103 in LED shop light lamp 3, linking opening 155 in LED strip light fixture 153 or connecting seat 200 in LED strip light fixture 190. However, when electrical power is to be transmitted to the LED linkable light fixture as described above, a patch plug 311 is employed. Referring to FIGS. 22 and 23, patch plug 311 is a one-piece unit, and includes at one end a power plug 313 that includes a pair of input prongs 315 and a ground prong 317. At the other end of patch plug 311 is a male plug 319 which is connected to power plug 313 by a middle injection part 321 (assuming patch plug 31 is made from an appropriate plastic).

Male plug 319 is composed of a relatively large, non-electrical conducting cylindrical tube 323 having an axially extending contact pin 325, and a linking electricity transmitting structure. The latter is in the form of a pair smaller and equal non-conducting cylindrical tubes 327. Tubes 323 and 327 are part of a composite unit in the form of a trefoil. Each of tubes 327 has an axially extending contact pin 329. Cylindrical tube 323 has an internal, cylindrical plastic shield 331, and merged cylindrical tubes 327 have internal, cylindrical plastic shields 333. When electrical power is to be supplied to one or more LED linkable light fixtures as described above, linking plug 303 of linking cord 301 is slid into male plug 319, and linking plug 303 at the other end of linking cord 301 is slid into the appropriate connection of an LED linkable light fixture such as linking orifice 51 of LED shop light fixture 1, linking opening 155 of LED strip light fixtures 153, or connecting seat 200 of LED strip light fixture 190. Similarly, power plug 313 is inserted into a three prong receptacle which are in common use. Once the proper connections are made and the switch is turned on, the LED linkable light fixture emits lumination.

The embodiments of the invention described above provide very useful and economical apparatus for converting a linking cord to a power cord having a linking plug at one end an outlet plug at the other end. The patch plug according to the invention is easy and economical to manufacture, and efficient, effective and safe in use.

The invention has been described in detail, with particular emphases on the preferred embodiments thereof, but variations and modifications may occur to those skilled in the art to which the invention pertains.

The invention claimed is:

1. A conversion device for converting a linking cord having opposite ends, and a linking plug at said opposite ends for linking two linkable LED lighting fixtures together to a linking cord for being electrically connectable to link a linkable LED lighting fixture to an electrical outlet for transmitting electricity from the electrical outlet to the linkable LED lighting fixture, said conversion device comprising:

a one-piece plug having opposite ends, said one-piece plug comprising:

a linking cord connection portion at one of said opposite ends of said one-piece plug for being operatively connectable to a linking plug mounted at one end of a linking cord, the linking plug at the opposite end of the linking cord provided for electrical connection to a linkable LED lighting fixture via the connected linking cord; and an electrical outlet connecting portion at the other end of said one-piece plug for connection with an electrical outlet to transmit electricity from the electrical outlet to a linkable LED lighting fixture when the linking cord connection portion at the opposite end of the linking cord is connected to the linkable LED lighting fixture said linking cord connection portion and said electric outlet connection portion being in operative electric connection to each other and comprising an integral unit.

2. A conversion device according to claim 1 wherein the linking plug includes peripherally connected non-electrically conductive tubes with electrical conducting internal sleeves, and wherein said linking cord connection portion comprises three merged tubes having respective internal conducting devices, said three merged tubes being provided to receive the three peripherally connected tubes of the input plug to transmit electricity to a linkable LED lighting fixture connected to the linking cord.

3. A conversion device according to claim 1 wherein the electrical outlet includes electrical prong receptacles;

and wherein said electrical outlet connection portion includes electrical prongs for insertion into the electrical prong receptacles of the electrical outlet for transmitting electricity from the electrical outlet to a linkable LED lighting fixture when the linking cord is electrically connected to the linkable LED lighting fixture.

4. A conversion device according to claim 3 wherein the electrical outlet further includes a grounding receptacle, and wherein said electrical outlet connection portion further includes a grounding plug for insertion into the grounding receptacle.

5. The combination of a linking cord for linking two linkable LED lighting fixtures together, and a one-piece, inflexible conversion device for converting the linking cord to a power cord for electrically connecting a linkable LED lighting fixture to an electrical outlet to enable the linkable LED lighting fixture to receive electricity from the electrical outlet;

said linking cord having two opposite ends and comprising a linking plug at both of said ends for insertion into an access of a linkable LED lighting fixture; and said one-piece, inflexible conversion device comprising:

an electrical outlet connecting portion for connection with an electrical outlet to transmit electricity from the electrical outlet to a linkable LED lighting fixture when the linking cord connection is connected to the linkable LED lighting device;

an electric conversion plug for cooperating with one of said linking plugs for transmitting electricity from an electrical outlet and into said linking cord for transmission to the linkable LED lighting fixture linked to said linking cord in response to the connection of said electrical outlet connection portion to the electrical outlet.

6. A one-piece patch plug for cooperating with a linking plug operatively connected to a linking cord, the linking cord also being operatively connected to a linking plug for transmitting electricity to a linkable LED light fixture through the linking cord;

wherein the linking plug includes electricity insulation tubular connectors having interior electricity conducting structure for transmitting electricity to the linking cord;

said patch plug comprising:

input prongs for insertion into an electrical receptacle to provide for the flow of electricity through said patch plug; and a female plug for cooperating with the linking plug to transmit electricity to a linkable LED light fixture, said female plug comprising:

non-electricity conducting tubes; and an electricity conducting contact pin extending inside said non-electricity tubes and in electrically conducting contact with said input prongs;

wherein said input prongs of said patch plug being insertable into an electrical socket and said female plug receiving said tubular connectors of the linking plug to transmit electricity to the interior electricity conducting structure for transmission along the linking cord to the linkable LED light fixture operatively connected to the lighting cord.

* * * * *